United States Patent [19]

Meyman

[11] 4,324,537

[45] Apr. 13, 1982

[54] ROTARY MACHINE WITH A PLURALITY OF ROTORS HAVING PERIPHERAL ROLLING CONTACT

[76] Inventor: Usher Meyman, 230 Ocean Pkwy., Brooklyn, N.Y. 11218

[21] Appl. No.: 93,609

[22] Filed: Nov. 13, 1979

[51] Int. Cl.[3] ..... F01C 1/12; F01C 17/02; F01C 17/06

[52] U.S. Cl. ..... 418/58; 418/132; 418/134; 418/135

[58] Field of Search ..... 418/58–60, 418/61 R, 132, 134, 196, 135; 123/246

[56] References Cited

U.S. PATENT DOCUMENTS

| | | | |
|---|---|---|---|
| 886,919 | 5/1908 | Ashley | 418/134 |
| 891,394 | 6/1908 | Benson | 418/134 |
| 1,164,897 | 12/1915 | Wellsteed | 418/134 |
| 2,691,945 | 10/1954 | Wichorek | 418/132 |
| 3,207,425 | 9/1965 | Morse | 418/196 |
| 3,234,888 | 2/1966 | Wise et al. | 418/196 |
| 3,929,402 | 12/1975 | Schubert | 418/58 |

FOREIGN PATENT DOCUMENTS

| | | | |
|---|---|---|---|
| 2221222 | 12/1973 | Fed. Rep. of Germany | 123/246 |
| 2293577 | 7/1976 | France | 418/196 |
| 36923 | 11/1935 | Netherlands | 418/196 |

*Primary Examiner*—John J. Vrablik
*Attorney, Agent, or Firm*—Ilya Zborovsky

[57] ABSTRACT

A rotary machine, such as a rotary engine, a rotary pump and the like, has a plurality of rotors which are so arranged and shaped that they roll over one another and together bound a permanently closed during rotation, working chamber. This working chamber is closed peripherally by the rotors, and axially by covers. The shape of the rotors may be formed by an inner envelope of a square which is connected with an inner larger circle rolling over a smaller circle. The shape of the rotors may also be produced by an inner envelope of a triangle whose inner larger circle rolls over a smaller circle.

9 Claims, 10 Drawing Figures

ROTARY MACHINE WITH A PLURALITY OF ROTORS HAVING PERIPHERAL ROLLING CONTACT

BACKGROUND OF THE INVENTION

The present invention relates to a rotary machine, such as a rotary combustion engine, a rotary pump and the like.

Rotary machines of the Wankel type are known in the art. The known machines have a housing with an epitrochoidal working surface and rotors provided with sealing elements. These rotary machines possess the disadvantages in that they have relatively small speeds of rotation of the rotors, insufficient tightness of working cavities, and relatively fast wear of the respective surfaces. Also rotary engines are known with hypotrochoidal surfaces. The utilization of the latter mentioned rotary engines encounters, however, difficulties because it is impossible to provide in them sufficient degree of compression. They also possess some disadvantages of the first-mentioned rotary machines.

SUMMARY OF THE INVENTION

Accordingly, it is an object of the present invention to provide a rotary engine or pump or the like, which avoids the disadvantages of the prior art.

More particularly, it relates to a rotary machine which is better than the known rotary machine in the sense of sufficient speed of rotor rotation, tightness of a working cavity, wear of the respective surfaces, degree of compression.

In keeping with these objects and with others which will become apparent hereinafter, one feature of the present invention resides, briefly stated, in a rotary machine in which a plurality of rotors are provided which are located relative to one another and are shaped so that during rotation of the rotors, they roll over one another and together bound a working cavity which is closed peripherally during the rotations and is open only at axial sides of the rotors.

The rotors may have a shape which is described by an inner envelope of a square which is connected with an inner circle which latter rolls over a smaller circle located inside, wherein the outer circle has a radius R and the inner circle has a radius r, and R: r=4:3. The rotors may also have a shape described by an inner envelope of a triangle having the same inner circle which rolls over the same smaller circle.

The novel features which are considered as characteristic for the present invention are set forth in particular in the appended claims. The invention itself, however, both as to its construction and operation will be best understood from the drawing together with the below presented description.

DESCRIPTION OF PREFERRED EMBODIMENTS

The drawings show a rotary machine in accordance with the present invention, embodied, for example, in a rotary combustion engine.

Figure 1:
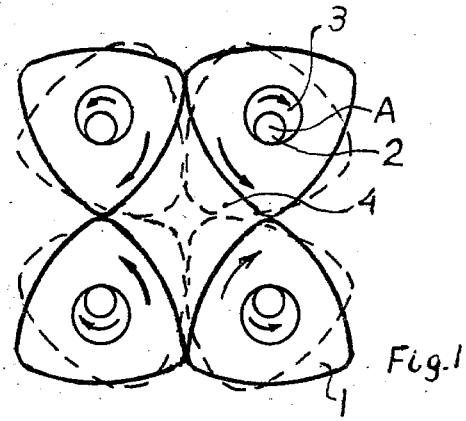
FIG. 1 is a view showing a rotary machine in accordance with the present invention, which includes four rotors.
Figure 1A:
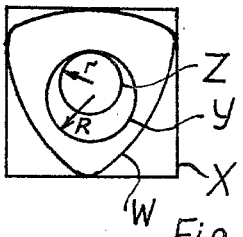
FIG. 1*a* is a view showing the shape of each of the rotors.

As shown in FIG. 1, the rotary engine includes four rotors which are identified by reference numeral 1. Each rotor has a shape which is produced in a manner shown in FIG. 1*a*. A square x has an inner circle y of a radius R and a center corresponding to the center of the square. The circle y roll over a smaller circle z without slippage, which smaller circle has a radius r, wherein R:r=4:3. This produces a contour which is identified by reference w and corresponds to the shape of the rotors 1. The contour is produced by a square inner envelope.

Each rotor is connected with a shaft 2 which can rotate about an axis A. The shaft 2 is provided with an eccentric 3 which may be of one piece with the shaft 2. Each rotor 1 can freely rotate about and relative to the respective eccentric 3. When the rotors 1 rotate in such a manner, their smooth peripheral surfaces always contact all sides of the square x. Each rotor has a gear which is identified by reference numeral 5 in FIG. 2.

The axes of the shafts are located in the apices of a square. More particularly, the axes of the two upper and two lower shafts are located on the parallel lines. Also the axes of the two left shafts and the two right shafts are located on the parallel lines, as can be seen from FIG. 1. Each two rotors contact one another in a plane of their symmetry.

When the thus-shaped and arranged rotors rotate synchronically, the peripheral surfaces of the adjacent rotors roll over one another without slippage in opposite directions and vary the cross sectional area of a working cavity 4 in the direction which is transverse to the axes of the rotors, and thereby vary the volume of the cavity 4. Since the profiles or contours of the rotors are decribed by the square, each rotor permanently contacts all four sides of the square. In other words, the points of contact of the profiles move along two straight lines. This is why the volume between the rotors is always closed and sealingly tight without additional sealing elements. Since the rotation of the rotors are synchronized, as will be explained hereinbelow, they roll one over the other withput slippage so as to rotate in opposite directions and cyclically vary the volume enclosed therebetween.

Figure 3:
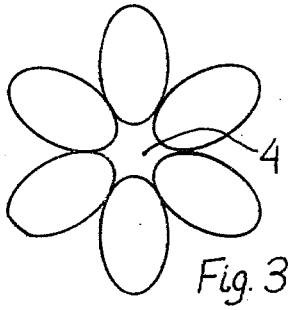
FIG. 3 is a view which schematically shows the inventive nachine which includes six rotors.

FIG. 3 schematically shows a rotary machine in accordance with a further embodiment of the invention. Here, the rotors are also shaped and arranged so that their peripheral surfaces roll over one another and bound the always closed working cavity. However, this rotary machine has six rotors and each of the rotors has a shape produced by an envelope described not by a square but by a triangle whose inner larger circle rolls over a smaller circle located inside, wherein the radii of the larger circle R and the smaller circle r relate to one another R: r=3:2.

Means for closing the working cavity 4 at its both axial ends is further provided. This means includes two covers 6 and 7 which are connected with one another by rods 8 and nuts 9. FIG. 2*a* shows a spring 10 which urges the nut 9 so that the latter always tends to screw onto the rod 8 to thereby tighten the connection of the covers 6 and 7 with one another. Gears 11 are further provided which mesh with the above-mentioned gears 5, wherein the latter has a smaller diameter and inwardly rolls over the inner teeth of the the gears 11. The numbers of teeths of the gears 11 and 5 relate to one another as 4:3.

Figure 2:
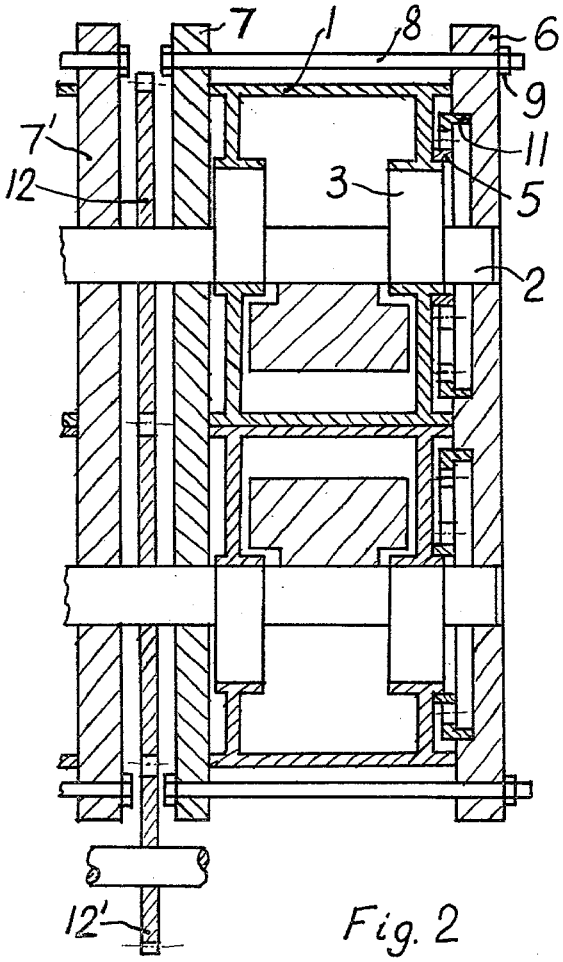
FIG. 2 is a view showing a section of the rotary machine of FIG. 1.
Figure 2A:
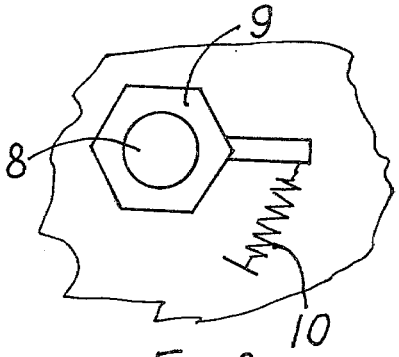
FIG. 2*a* is a view showing urging means for urging one of the covers into movement relative to the other cover of the machine.

The rotors 1 are hollow, as can be seen in FIG. 2. The shafts 2 of the rotors 1 are provided with compensating masses to counteract the eccentrics. They are located inside the rotors 1. The shafts 2 are further provided with gears 12 which mesh with one another as also can be seen in FIG. 2. The gears 12 synchronize the rotation of all shafts. Moreover, they transfer the power from all shafts to one of the shafts which serves as an output shaft.

As can be seen in the same FIG. 2, the rotary machine in accordance with the present invention, may includes a second group of such four rotors which are shown in FIG. 1. Only a left cover 7' of such a second group is shown in FIG. 1. The respective rotors may have the common shafts extending through the axially spaced rotors of both groups. In this construction, an additional gear 12' is provided which meshes with one of the gears 12 and receives the power from the latter and thereby from all other shafts. A shaft of the gear 12' serves as an output shaft of the machine.

Figure 4:
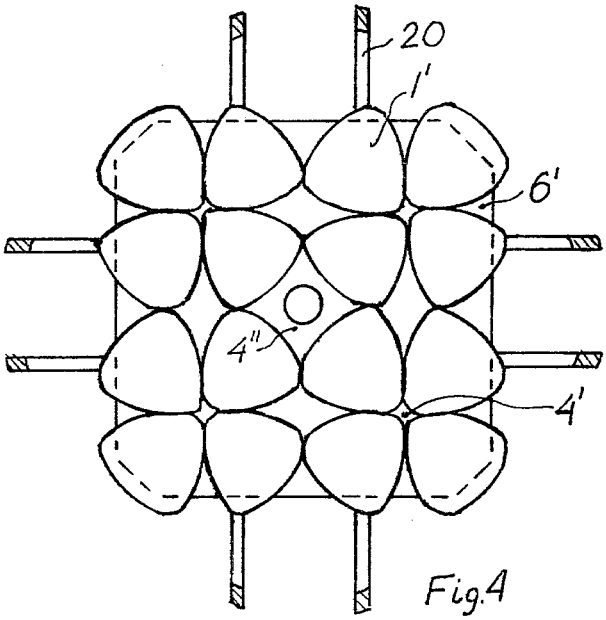
FIG. 4 is a view showing the inventive machine including sixteen rotors.
Figure 6:
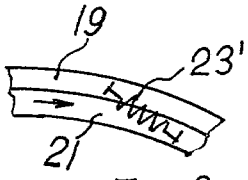
FIGS. 6 and 7 are views showing further urging means for the covers of the inventive machine.

The rotary machine in accordance with the present invention, may have sixteen rotors such as shown in FIG. 4. The rotors of FIG. 4 has a shape which is identical to the shape of the rotors of FIG. 1. The rotors 1' of this machine together form 9 cavities of which 8 cavities 4' are utilized as working cavities, whereas a central cavity 4'' is utilized for cooling purposes. The rotors 1 of the rotary machine of FIG. 1, as well as the rotors of the rotary machine of FIG. 4 which are located outside (ten rotors) may be cooled from outside by conventional means, such as an air impeller. The inner four rotors 1', however, are cooled by a cooling medium which is supplied into the interior of the cooling cavity 4''. Eight cavities 4' include two cavities for each stroke of the cycle of operation of the rotary machine.

Means for supplying a working fluid or mixture, such as gas or liquid, and withdrawing of spent fluid such as discharge gases, is further provided. This means, or in other words, a valve timing mechanism, may be formed for the rotary machine of FIG. 1 as a conventional sliding valve timing mechanism.

For the rotary machine shown in FIG. 4, this mechanism includes a disc member 13 provided with a forked two—passage pipe 14. having two outlets 15. The disc member 13 also has two inlets 16. When the disc member 13 rotates, the outlets 15 coincide with two cavities which perform the suction stroke, and the inlets 16 coincide with two cavities which perform the exhaust stroke. The remaining two pairs of cavities are the cavities wherein the stroke of compression and the working stroke are performed. These two pairs of cavities are closed at this moment. The exhaust gases flow around the pipe 14 and exit into a casing 17 to be discharged therefrom.

Figure 5:
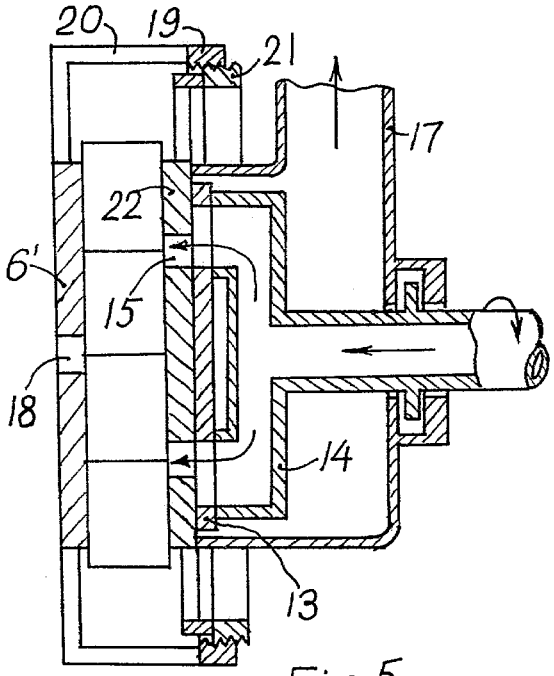
FIG. 5 is a view showing a section of the machine of FIG. 4.
Figure 5A:
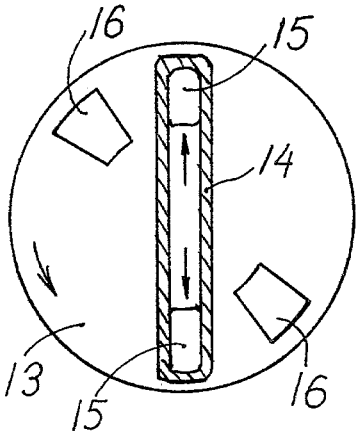
FIG. 5*a* is a view of a valve timing mechanism.

The rotary machine of FIGS. 4 and 5 has a cover 6' provided with a cooling opening 18, As for the other cover, it includes a cover member immovably connected with the cover 6' by rods 20 for example by welding, and inwardly threaded. An outwardly threaded ring 21 is located axially adjacent to a wall 22 and meshes with the cover member 19. When the ring 21 is screwed into the cover member 19 it displaces the disc 22 inwardly so that the latter firmly abuts against the rotors.

Figure 7:
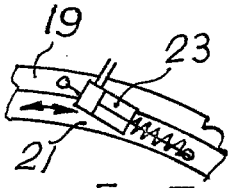

Additional urging means is provided and includes a spring located between the cover member 19 and the ring 21 so as to urge the latter to screw into the former. Such urging means may alternately include a pneumatic cylinder-and-piston unit 23 shown in FIG. 7 and provided with a check valve and a return spring. The cylinder and the piston of the unit are connected respectively to the cover member 19 and the disc 21 or vice versa. The hollow of the cylinder communicates with, for example, the working cavity of the machine. During the operation of the machine, the pressure in the cylinder increases and the unit urges the disc 21 to screw into the cover member 19. The supply of pressure is controlled by the check valve. When the operation of the machine terminates, the check valve is switched off, the pressure in the unit decreases. The return spring urges the disc 21 in the unscrewing direction so as to somewhat release the tightneess of the connection.

The operation of the rotary machine is believed to be evident. The working medium or mixture is supplied into the working cavity, ignited and expands there, and thereby the rotors rotates about their axis to perform the working stroke. The rotary machine thus operates as an engine. When the rotors are rotated from outside and a working medium is displaced by the rotors, the machine operates as a pump. The machine may have any number of rotors, such as four and exceeding four rotors.

It will be understood that each of the elements described above, or two or more together, may also find a useful application in other types of constructions differing from the types described above.

While the invention has been illustrated and described as embodied in specific machines, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features, that from the standpoint of prior art, fairly constitutes essential characteristics of the generic or specific aspects of the present invention.

What is claimed as desired to be protected by Letters Patent is set forth in the appended claims:

1. A rotary machine, such as a rotary combustion engine, a rotary pump and the like, comprising a plurality of rotors rotatable about substantially parallel axes and having peripheral surfaces, said rotors being located relative to one another and each having a shape such that said rotors during the rotation about said axes roll by their peripheral surfaces one over the other without slippage and together bound at least one working cavity which is open at its both axial ends but is permanently closed peripherally by said peripheral surfaces of said rotors, each of said rotors having a shaft with an eccentric and being rotatable on said eccentric;

means for closing said cavity at said axial ends thereof and including two cover members located at both axial sides of said rotors;

a gear provided on each of said rotors so that said gear is arranged not on said shaft of said rotor but on said rotor itself, said gears having outer teeth; and gears provided on said cover members and each having inner teeth, each of said gears of said rotors engaging with a respective one of said gears of said cover members.

2. A rotary machine as defined in claim 1, wherein each of said rotors has a shape which is described by an inner envelope of a triangle which is connected with an inner larger circle rolling over a smaller circle, wherein the relation between the radius of said larger circle R and said smaller circle r is equal to 3:2.

3. A rotary machine as defined in claim 1, wherein each of said rotors has a shape which is described by an inner envelope of a square which is connected with an inner larger circle rolling over a smaller circle, wherein the relation between the radius of said larger circle R and said smaller circle r is equal to 4:3.

4. A rotary machine as defined in claim 3, wherein said plurality of rotors includes four such rotors.

5. A rotary machine as defined in claim 3, wherein said plurality of rotors includes sixteen such rotors which together form nine cavities, of which eight cavities are arranged to serve as working cavities, whereas the ninth cavity communicates with a source of cooling medium so as to serve as a cooling cavity.

6. A rotary machine as defined in claim 5; and further comprising valve timing means including a disc member with a forked pipe with two inlet opening, said disc member also having two outlet openings and being rotatable so that said inlet openings coincide with two working cavities performing a suction stroke and at the same time said outlet openings coincide with two other working cavities performing an exhaust stroke, whereas the remaining working cavities are closed.

7. A rotary machine as defined in claim 1, wherein said closing means includes two cover members located at both axial sides of said rotors, one of said covers being movable relative to the other of said covers so as to provide for tight closing of said working cavity; and further comprising means for urging said one cover into movement relative to said other cover.

8. A rotary machine as defined in claim 7, wherein said urging means includes a spring, one of said cover member including a part which is immovably connected with said other cover member and is threaded, and a further part which is also threaded and urged to screw into said first-mentioned part under the action of said spring.

9. A rotary machine as defined in claim 7, wherein one of said cover members includes a first threaded part which is immovably connected with said other cover member, and a second threaded part which is screwed into said first part and urged by said urging means, said urging means including a cylinder-and-piston unit connected with said parts and communicating with said working cavity so that during the operation of the rotary machine said cylinder-and-piston unit urges said second part to be screwed into said first part.

* * * * *